US007536118B2

(12) United States Patent
Sippel et al.

(10) Patent No.: US 7,536,118 B2
(45) Date of Patent: May 19, 2009

(54) METHOD FOR ELIMINATING ERRORS DURING OPERATION OF AN ELECTROGRAPHIC PRINTER OR COPIER DEVICE, AND ELECTROGRAPHIC PRINTER OR COPIER DEVICE AND COMPUTER PROGRAM

(75) Inventors: Helmut Sippel, München (DE); Christoph Nemmaier, München (DE)

(73) Assignee: Oce Printing Systems GmbH, Poing (DE)

( * ) Notice: Subject to any disclaimer, the term of this patent is extended or adjusted under 35 U.S.C. 154(b) by 394 days.

(21) Appl. No.: 10/525,302

(22) PCT Filed: Aug. 14, 2003

(86) PCT No.: PCT/EP03/09045

§ 371 (c)(1),
(2), (4) Date: Aug. 2, 2005

(87) PCT Pub. No.: WO2004/017144

PCT Pub. Date: Feb. 26, 2004

(65) Prior Publication Data

US 2006/0182454 A1 Aug. 17, 2006

(30) Foreign Application Priority Data

Aug. 14, 2002 (DE) ..... 102 37 300

(51) Int. Cl.
*G03G 15/00* (2006.01)

(52) U.S. Cl. ..... 399/18; 399/21

(58) Field of Classification Search ..... 399/18, 399/21

See application file for complete search history.

(56) References Cited

U.S. PATENT DOCUMENTS

| | | | | |
|---|---|---|---|---|
| 5,479,240 | A | 12/1995 | Lee et al. | |
| 5,999,757 | A * | 12/1999 | Shimomura et al. | 399/9 |
| 6,317,581 | B1 * | 11/2001 | Boehmer et al. | 399/401 |
| 6,408,407 | B1 * | 6/2002 | Sadler | 714/57 |

FOREIGN PATENT DOCUMENTS

| | | | |
|---|---|---|---|
| DE | 32 13 577 | A1 | 11/1982 |
| EP | 0 416 919 | A2 | 3/1991 |
| EP | 0 583 928 | A2 | 2/1994 |
| EP | 0 810 484 | A1 | 12/1997 |
| EP | 1 349 067 | A2 | 10/2003 |
| WO | WO 98/18052 | A1 | 4/1998 |
| WO | WO 98/18055 | | 4/1998 |
| WO | WO 98/18060 | | 4/1998 |
| WO | WO 98/39691 | | 9/1998 |

* cited by examiner

*Primary Examiner*—Anthony H Nguyen
*Assistant Examiner*—Andy L Pham
(74) *Attorney, Agent, or Firm*—Schiff Hardin LLP

(57) ABSTRACT

A method is provided for controlling a printer or copier device by which errors, such as paper jams, can be cleared automatically. A controller commands a module having the error to clear the error automatically. The commands are sent to modules beginning at the output of the printer or copier device and moving in a reverse direction to the paper flow direction of the printer or copier so as to automatically clear errors such as paper jams. Status signals indicating whether the error has successfully been cleared are reported back to the controller. A printer or copier for carrying out the method and a computer program for carrying out the method are also disclosed.

9 Claims, 2 Drawing Sheets

METHOD FOR ELIMINATING ERRORS DURING OPERATION OF AN ELECTROGRAPHIC PRINTER OR COPIER DEVICE, AND ELECTROGRAPHIC PRINTER OR COPIER DEVICE AND COMPUTER PROGRAM

BACKGROUND OF THE INVENTION

1. Field of the Invention

The present invention relates generally to an electrographic printer or copier device method and apparatus and, in particular, to a method for eliminating errors during operation of an electrographic printer or copier device as well as to a printer or copier device that eliminates errors and to computer program therefor.

2. Description of the Related Art

Printing and copying devices (which are referred to generally as printing devices in the present disclosure) typically include a number of component systems for a printer and each component system is composed of several modules. Examples of such component systems include the printing component system, the input component system and the output component system. An example of a printing device is disclosed in PCT International published patent application WO 98/18052 A1. This device includes a printing component system having two printing modules. The printing modules each include a photoconductor drum, a transfer module, a fixing module, and a module for determining the paper transport path for the printable media through the printing component system. Further component systems are also provided such as an input system and an output system which may, for example, include a stapler as a module in the output system.

In printing devices of this type, errors can occur during the operation of the printer that need to be eliminated. For instance, congestion can occur in the printable medium transport path in, for example, the transfer module, or in the switching module or in the fixing module. To eliminate these types of errors, the PCT International published patent application WO 98/18055 A1 discloses a shutter device to provide access to the transport path. The reference discloses the construction of the shutter device as well as other adjustments that allow access to the transport path. To eliminate the congestion of the printable materials in the shutter device, service personnel are needed to operate the shutter device.

According to U.S. Pat. No. 5,479,240, an error, a paper jam or congestion can be eliminated in a copying device without an operator having to intervene. According to this patent, the following steps must be carried out: An initial examination is made to determine if the paper jam can be eliminated automatically. If this is not the case, a manual elimination of the problem will be called for. If the error can be eliminated automatically, sensors will determine in which component system the error appeared. If the component system has been identified, the component system will be started by the control unit to transport any damaged sheets of paper further. If the transport effort is not successful within a predetermined period of time, a manual error correction must be performed. If the transport of the damaged paper through the component system has been successful, a further transit through succeeding components will be attempted in a corresponding manner until the damaged sheet of paper reaches the output component.

The published European published application EP 0 810 484 A1 discloses a transport system for printable material in which individual components of the transport system can automatically execute a task after they receive control information from a central control unit. The components are designed such that they can implement a self-diagnosis and a self-repair. These actions occur in parallel with that of the central controller. If the central control unit has determined that an error exists, it gives control information in which the type of error that has occurred is specified to the components. This information enables the components to eliminate the error automatically.

In the published European published application EP 0 416 919 A2, a synchronization between the image sampling and paper transport in a copier device is disclosed. If it is determined that the transport of the paper is too slow, the copying process will be stopped.

In the published European published application EP 0 583 928 A2, a device in which the paper feed can be monitored in the transport path of a printer device is disclosed. The rotation speed of the transport rollers for the carrying the paper is measured. If the measured rotation speed does correspond to a predetermined shutter device, an error message is generated.

SUMMARY OF THE INVENTION

The present invention provides a method for correcting an error in a printing device, such as a jam in the printable medium which occurs in a transport path, without calling on service personnel. This and other features and advantages of the invention are provided by a method for automatically eliminating errors occurring during the operation of an electrographic printer or copier device. The method provides that upon the occurrence of an error in a component, a determination is made as to whether the error can be automatically corrected in a main error correction mode. In case the error can be corrected, the individual modules are switched to an error-correcting mode in succession, otherwise the main error correcting mode is ended. The modules are tested in the opposite direction to the flow of the printable materials along the transport path.

In particular, a query is sent to the component system for a module to correct the error. If this is successful or if no error is present, a status signal indicating that the "error has been corrected" is transmitted, otherwise the status signal the "error is not corrected" is transmitted. In case the module transmits the status signal that the error has not been corrected, a determination is made as to whether the operation can proceed without this module and, if so, the status signal "operation is possible" is transmitted, otherwise the status signal "error is not corrected" is transmitted. After each of the modules has been queried according to the foregoing, if an occurrence of a status signal indicating the "error has not been corrected" occurs in at least one module, the error correcting mode is ended and the module which registers the error is reported. Otherwise, the error correcting mode ended and a status signal is transmitted that the error has been corrected.

Module control units provide for the operation of the modules and are under the supervision of a main control unit, these module control units are used to check the modules for errors. If an error is determined to be correctable, the modules are instructed to correct the error. It is advantageous to check each module of each component system in succession and, in particular, to begin with the last module as viewed in the paper transport direction and to successively test adjacent and preceding modules for the correction of the printable material error. At the completion of testing, either the error has been corrected or a status signal indicating that the "error was not corrected" is transmitted. According to one aspect of the invention, if one of the modules has an operating error, a determination is made as to whether it is possible to operate the printing device without this module and, if so, to provide a report as such.

Thus, an error correction may be carried out separately for each component system in this manner. It is possible to test all of the components, one after another, in the direction opposite that of the paper transport direction on a module-by-module manner and to correct errors, if possible.

DETAILED DESCRIPTION OF THE PREFERRED EMBODIMENTS

Figure 1:
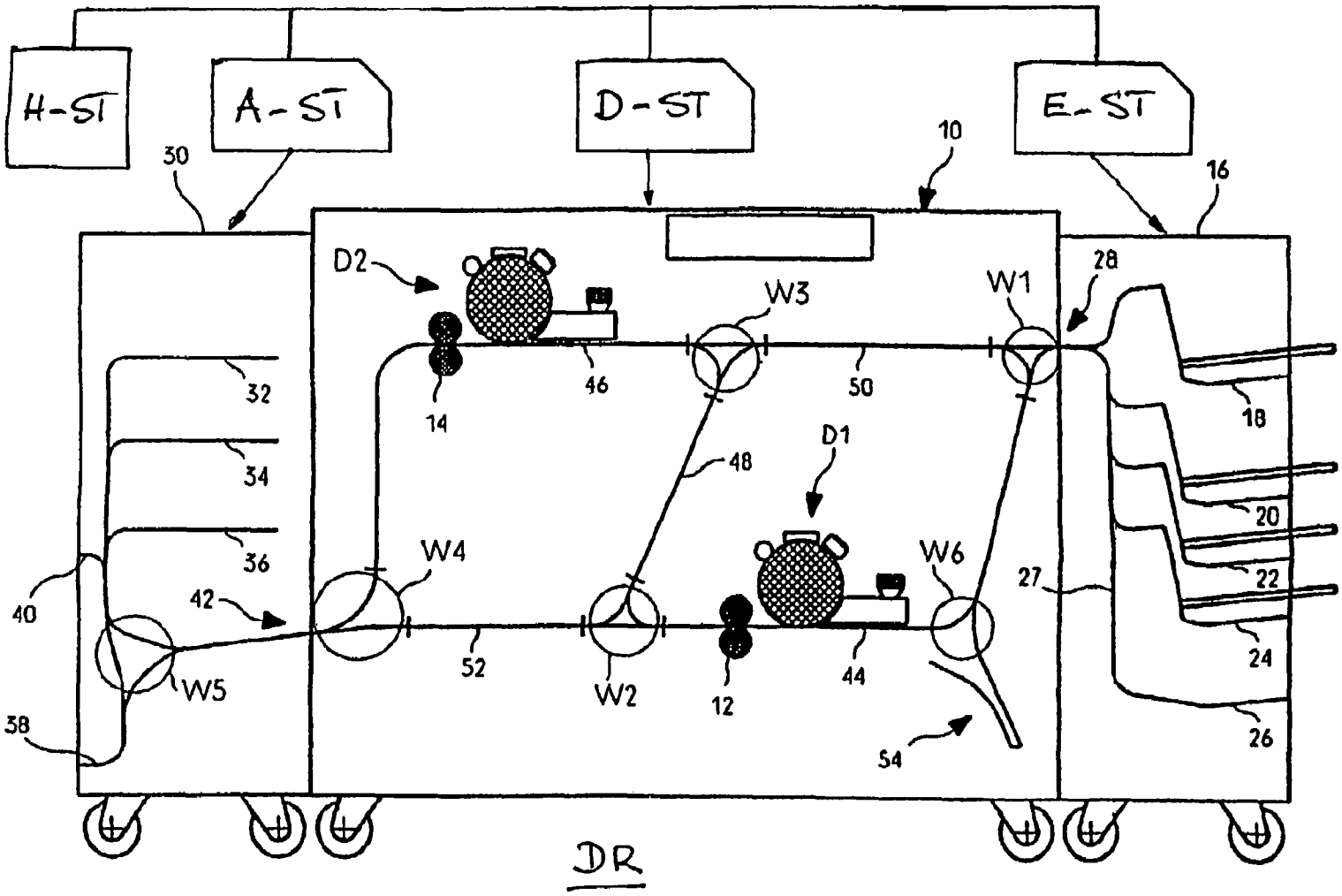
FIG. 1 is a side view of a printer apparatus for printing single sheets of printed material and showing in block diagram a controller system for use by the present method.

In FIG. 1 is shown a printing apparatus for printing single sheets of printed material. The illustrated printer is of a type as disclosed in the PCT published patent application WO 98/18060 A1; however, a controller system for carrying out the present method has been added. Only the components of the printer which are applicable to the present invention are described herein. For other component system descriptions, refer to the PCT published application WO 98/18060 A1, which is incorporated herein by reference.

A printing device DR, as shown in FIG. 1, includes three components: a printing component system 10, an input component system 16 for inputting printable media and an output component system 30 for outputting printed material. The printing component system 10 is assembled from modules. For example, along the transport path 50 and 52 lie printable material switch modules W, two printing groups D1 and D2, and fixer modules 12 and 14. Construction of these modules is well known. The printing groups D1 and D2 can be constructed as electrographic printing groups that include a photoconductor drum on which charge images of images to be printed are generated in a known manner. The charge image is developed with a toner and is transfer printed onto the printable material by transfer modules 44 and 46. The switch module W assists in feeding single sheets of printable material to the printing groups D1 and D2, either separately or sequentially, for printing on the front and/or back of the paper. The input and output components 16 and 30 for the printable materials are assembled from modules as well. As is apparent in FIG. 1, the output switch modules W through which the sheets of printable material are conducted include output containers 32 through 36 or may have output channels which lead to following units such as staplers or the like. The input switch modules W move printable materials from the input component 16 that includes supply containers 18 through 24 for pages of material to be printed and an input channel 26 through which material to be printed can be supplied from other units.

The individual components of the printing system DR are controlled by component control units ST. The print component 10 is controlled by a print component control D-ST, the input component 16 is controlled by an input component control E-ST and the output component 30 is controlled by the output component control A-ST. These component controls ST are linked with a main control H-ST that coordinates the operation of the print device. The component controls ST are of a know design and therefore are not described further. Examples of such control units are set forth in PCT published application WO 98/39691 A1.

If an error occurs in the transporting of material to be printed through the print device DR, such as a paper jam of the printable material, it must be determined in which component and in which module of the component the error has occurred. Furthermore, it must be determined whether the error is correctable without the intervention of service personnel. The component controls ST are active and emit error reports upon the occurrence of such errors and forward these error reports to a main control H-ST so that the location of the error can be recognized. Advantageously, the present method enables these error reports to be used to automatically eliminate errors when possible. For this to occur, the error must be one that can be corrected without the intervention of service personnel.

For example, if an error exists in a particular switch module W, an attempt can be made to clear the paper transport path by changing the switch position. If this is not possible, an attempt can be made to choose another paper transport path via adjustment of another switch module W. These same procedures can be applied for errors which occur in a printer group or in a fixing module. An attempt can also be made to correct the errors or to search for another transport path.

Figure 2:
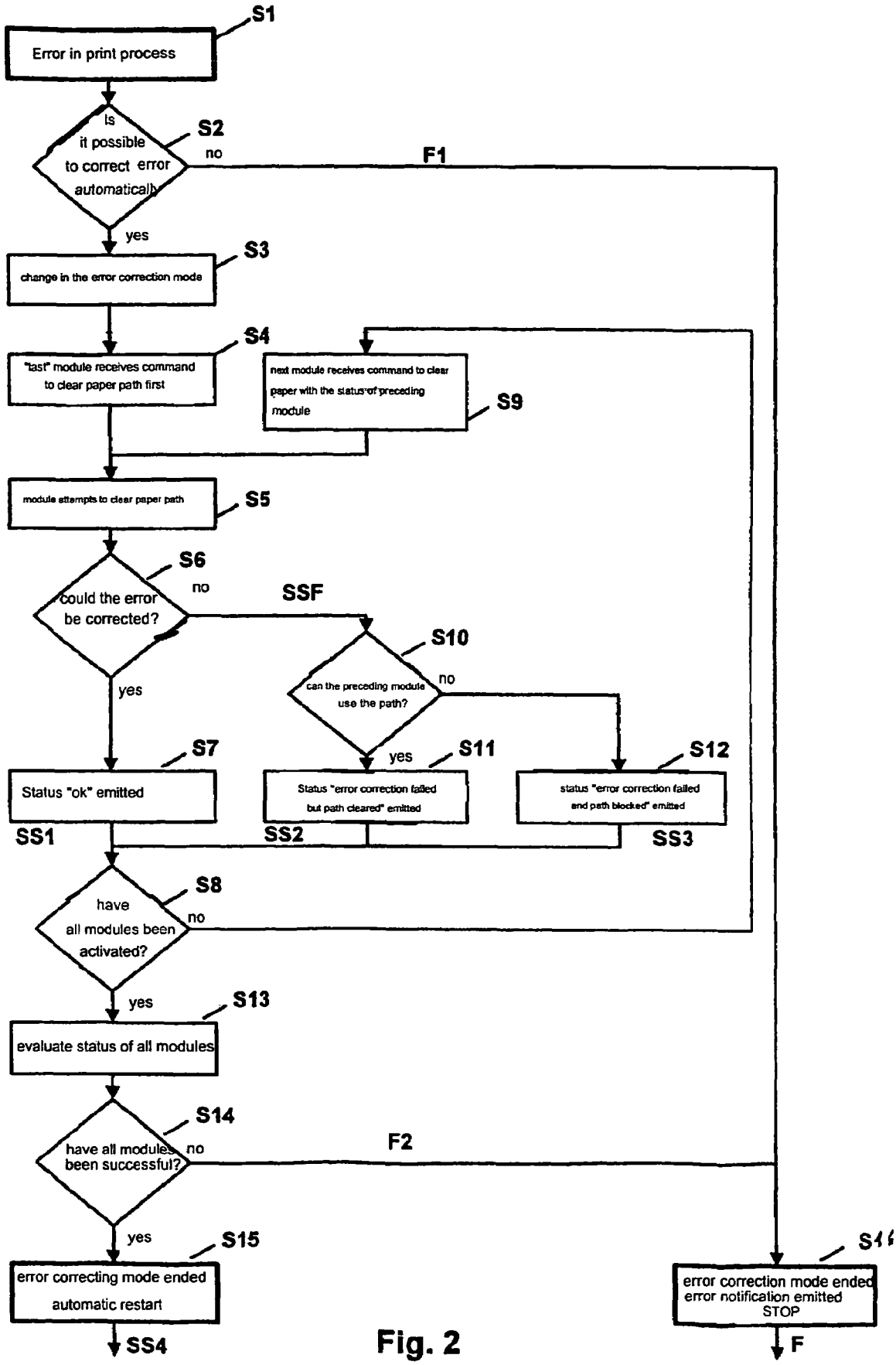
FIG. 2 is a flow diagram illustrating the method of the present invention.

With reference to the flow chart of FIG. 2, the process for correction of an error, for example, an error in a transport path for the printable material is shown. The process flow is depicted from the viewpoint of the main control H-ST. It is assumed for purposes of the present example that the error exists in the printer unit 10.

A determination is made in step S1 that an error has occurred in the paper transport path which passes through the printing unit 10. This determination is made by the print component control D-ST. In step S2, the main error correction mode is switched on and a test is run as to whether the error can be automatically corrected. For this determination, the error is reported to the main control H-ST, which decides whether the error correction will be attempted. Thus, for example, a determination is made as to whether the error is correctable in the fixing module 12 and, if it is not possible to correct the error, whether another transport path can be set to the fixing module. If this is not the case, then the error correcting efforts for this particular print group is ended and an error report F1 is generated and supplied to the main control H-ST so that in step S16, the main error correcting mode ends and a signal status F is sent indicating that the error has not been corrected.

If the error is automatically correctable according to step S2, the corresponding component control D-ST is changed to the error correcting mode as shown in step S3. In the subsequent step S4, a command is transmitted by the component control D-ST to the module that lies at the output of the paper transport path. The command prompts this module, which is, for example, the switch module W-4 to empty the paper transport path. Thereafter, in step S5, the module attempts to clear the transport path. Whether this was possible is determined in step S6. If the error can be corrected, the assigned component control D-ST sends the status signal SS1 or "error corrected" in step S7. In step S8, a query is issued as to whether all modules of the component are processed. If this is not the case, the process proceeds to step 9 and the next module in the reverse direction to the paper flow path receives a command to examine and, if necessary, to clear the transport path. For example, this next module for the error connection (which is the preceding module from the paper transport direction) might be the fixing module 14. After this occurs, the result reverts back to step S5. In the step S9, the status of the previously examined module can also be communicated to the next module. When, as illustrated in step S6, it has been established that an error cannot be corrected, such as using the status signal SSF, even though the preceding module can use the transport path as indicated in Step S10, then a status signal SS2 is transmitted in step S11 to indicate that the error cannot be corrected but that the transport path is clear. If this is not possible, a status signal SS3 is transmitted in step S11 to indicate that the error correction has failed and that the transport path through the module is blocked.

If the inquiry in step S8 determines the error modes of that all modules of the printer component 10 are processed, then in step S13, the status of all tested modules can be evaluated and in step S14 it can be determined whether all modules were successful in the correction of the error. If this is the case, then in step S15 a status signal SS4 indicating that the error correction mode has ended is sent out and the printer device DR is possibly restarted. When the inquiry in step S14 provides a negative result, then the error signal F2 is sent with the consequence that, for example, the main control H-ST stops the printer device. The status signal F is transmitted that indicates that the error has not been corrected.

The present method has been explained by an example of a printer component 10. The input component 16 or the output component 30 or other components of a printer or copier can be treated comparably. Furthermore, it is also possible to initiate the test within a component.

In conclusion, the method can be applied so that an entire printing device is tested, the testing initially testing the modules of the output component 30 for the printed material, then testing the modules of the printing unit 10, and finally testing the modules of the input component 16.

The method can be effected via a device control for an electrographic printer or copier device that includes electronic components such as hardware and firmware and, as the case may be, a processor in which a computer program runs. The computer program, including computer programs stored on storage media such as computer diskettes, CD-ROMs, magnetic tapes, optical storage disks, and hard disks are therefore within the scope of the present invention as well as computer program files for performing the methods which are maintained on such storage media or which are exchanged or distributed over computer networks, such as LAN, WAN and the Internet.

Errors which occur in a paper transport path or transport path for other materials to be printed or copied within an electrographic printing or copying device are automatically corrected as much as possible with this method. The individual modules of components of the printing device are tested in a direction counter to the direction of the paper or media transport, one after another, with the result that a module may be able to or may not be able to eliminate the error. In case the error cannot be eliminated, a further test is established to determine whether the module having the error can be bypassed. A status report is generated at the end of the testing process for every examined module and, depending on the results, the printing process is initiated again or the printing device is stopped.

Although other modifications and changes may be suggested by those skilled in the art, it is the intention of the inventors to embody within the patent warranted hereon all changes and modifications as reasonably and properly come within the scope of their contribution to the art.

We claim:

1. A method for automatically correcting an error during operation of an electrographic printing or copying device, comprising the steps of:

determining whether the error can be automatically corrected in a main error correction mode, and in case the error cannot be corrected, ending the main error-correcting mode;

in case the error can be corrected, switching individual modules to an error-correcting mode in succession;

querying the individual modules in a sequence opposite to that of a printable media transport direction, said querying including testing a first module by transmitting a command to correct the error to said first module, said command including instructing the first module to move the printable media in the media transport direction in order to clear the first module, transmitting a status signal indicating that the error is corrected if the error correction is successful or if no error is present, otherwise transmitting a status signal indicating the error is not corrected, if the status signal indicating that the error has not been corrected in the first module is transmitted, making a determination as to whether operation of the electrographic printing or copying device can proceed without the first module that has the error and, if so, transmitting a status signal indicating that operation is possible, otherwise transmitting a status signal that the error is not corrected, and testing the further modules preceding the first module and clearing those modules if necessary; and if after checking and attempting to clear the modules, the status signal indicates that the error has not been corrected in at least one of the modules, then ending the error-correcting mode and reporting the module registering the error, otherwise ending the main error-correcting mode and transmitting a status signal indicating that the error has been corrected.

2. A method as claimed in claim 1, further comprising a step of:

in case a module indicates a status signal showing that an error has not been corrected, determining whether the module can be bypassed; and if the module can be bypassed, then transmitting a status signal indicating operation possible, otherwise transmitting a status signal indicating error not corrected.

3. A method as claimed in claim 1, further comprising a step of:

controlling error correction by a dedicated control unit of a querying unit that is controlled by a main control unit of the printing or copying device.

4. A method as claimed in claim 1, further comprising the step of:

separately testing the plurality of consecutively arranged modules of the printing or copying device.

5. A method as claimed in claim 1, further comprising the step of:

initiating testing of a plurality of consecutively arranged modules in the media transport path of the printing or copying device beginning with a last module in the media transport direction and proceeding with testing of modules in the media transport path in the direction opposite the media transport direction through to a first modules in the printable media transport flow path.

6. A method as claimed in claim 1, wherein said modules of the printing or copying device include an input module and an output module for printable media.

7. A method as claimed in claim 6, wherein print modules are disposed in multiple groups between said input modules and said output module and further comprising at least one switch module so that a plurality of transport paths are defined for printable media.

8. A method as claimed in claim 1, wherein said modules include transport modules for transporting printable media, said error is an error in paper transport, and a correction is undertaken to correct a paper jam of at least one sheet of the printable media.

9. An electrographic printing or copying device, comprising:

an input module for printable media to be printed;

a print module including at least one printable media transport path, said print module printing on said printable media;

an output module connected to said print module to receive printed printable media;

a controller connected to said input module, to said print module, and to said output module to detect an error and determine whether the error can be corrected automatically in a main error-correcting mode, said controller switching to said main error-correcting mode in case the error can be corrected, otherwise not initiating said main error-correcting mode;

said controller in said main error-correcting mode performing the steps of querying the individual modules in a sequence opposite to that of a printable media transport direction, said querying including testing the output module by transmitting a command to correct the error to said output module, said command including instructing the output module to move the printable media in the media transport direction in order to clear the output module, transmitting a status signal indicating that the error is corrected if the error correction is successful or if no error is present, otherwise transmitting a status signal indicating the error is not corrected, if the status signal indicating that the error has not been corrected in the output module is transmitted, making a determination as to whether operation of the printing or copying device can proceed without the output module that has the error and, if so, transmitting a status signal indicating that operation is possible, otherwise transmitting a status signal that the error is not corrected, testing the print module and input module preceding the output module and clearing those modules if necessary, and if after checking and attempting to clear the modules, the status signal indicates that the error has not been corrected in at least one of the modules, then ending the error-correcting mode and reporting the module registering the error, otherwise ending the main error-correcting mode and transmitting a status signal indicating that the error has been corrected.

* * * * *